United States Patent [19]

Knight et al.

[11] Patent Number: 4,934,061

[45] Date of Patent: Jun. 19, 1990

[54] DRAUGHTING TABLES, DRAWING BOARDS, DRAWING INSTRUMENTS AND ANALOGOUS APPARATUS

[76] Inventors: Jonathan Knight, 36 Devonshire Road, London, W4 2EX; Martin Riddiford, 23 Elfindale Road, London, SE24; Stephen O. Frazer, 124 Fordwych Road, London, NW2 3PB, all of England

[21] Appl. No.: 255,163

[22] PCT Filed: Apr. 3, 1987

[86] PCT No.: PCT/GB87/00235

§ 371 Date: Oct. 3, 1988

§ 102(e) Date: Oct. 3, 1988

[87] PCT Pub. No.: WO87/05863

PCT Pub. Date: Oct. 8, 1987

[30] Foreign Application Priority Data

Apr. 3, 1986 [GB] United Kingdom ..... 8608165

[51] Int. Cl.[5] ..... B43L 13/02

[52] U.S. Cl. ..... 33/403; 33/DIG. 1; 33/449; 33/443

[58] Field of Search ..... 33/471, 403, 430, 438, 33/448, 449, DIG. 1, 465, 443; 335/285

[56] References Cited

U.S. PATENT DOCUMENTS

| | | | |
|---|---|---|---|
| 1,406,061 | 2/1922 | Muller | 33/438 |
| 2,360,911 | 10/1944 | Tress | 33/449 |
| 3,618,137 | 11/1971 | Bassett | 335/285 |
| 3,672,062 | 6/1972 | Baker | 33/449 |
| 3,866,326 | 2/1975 | Hebel | 33/438 |

FOREIGN PATENT DOCUMENTS

| | | | |
|---|---|---|---|
| 969111 | 5/1950 | France | 33/449 |

*Primary Examiner*—Harry N. Haroian
*Attorney, Agent, or Firm*—A. W. Breiner

[57] ABSTRACT

Drawing boards and drawing instruments for use therewith. The surface of the board (1) has a set of parallel-running, evenly spaced magnetic poles (2) across it. Each drawing instrument has a cylinder (10) with similar parallel magnetic poles running essentially axially along it. The cylinder is freely rotatably mounted (12) and preferably held a little bit away from the board surface. The cylinder (10) preferentially orientates with its magnetic poles aligned with those (2) on the board surface. This orientation can be accurately maintained across the entire surface of the board without the use of cumbersome mechanical arrangements to ensure alignment of drawing instruments. When not required for use, the drawing instrument may simply be removed from the surface of the board. A ruler/protractor device (3) and a carriage bearing a pair of rules set at right angles are described.

10 Claims, 4 Drawing Sheets

DRAUGHTING TABLES, DRAWING BOARDS, DRAWING INSTRUMENTS AND ANALOGOUS APPARATUS

This invention relates to draughting tables and drawing boards, to drawing instruments, and to analogous apparatus.

The making of engineering and manufacturing drawings is conventionally done by draughtsmen working with appropriate apparatus. The fundamental requirement is for a baseboard and means for attaching to that baseboard a sheet of paper, draughting film or the like on which the drawing is to be done. In much engineering drawing there is a requirement for extensive use of lines which run either horizontally or vertically and much need to draw lines accurately parallel or at right angles one to another. In order to facilitate drawing such lines, it is conventional practice to provide in association with such a draughting table appropriate apparatus, including some sort of mounted pair of rulers, one set at right angles to the other, and means for moving the pair accurately vertically and horizontally. One well known system consists of an upper track mounted along the top of the board in which a carriage slides. Mounted on that carriage is a vertical track generally running from top to bottom of the board, with a second carriage mounted in the vertical track. The second carriage can thus move up and down the board by sliding in the vertical track, while the whole assembly of second carriage and vertical traCk may be moved from side to side.

Mounted on the second carriage there is generally a pair of rulers set at right angles one to another. The pair may extend from a central member which is mounted pivotally on the second carriage, there being cooperating means on the pivotal member and second carriage to enable the rulers to be pivoted around an axis perpendicular to the surface of the board through a range of, e.g. 90°. Locking means may be provided to enable the rulers to be locked at a particular orientation, and latch means may be provided to enable the rulers to be locked in a number of spaced predefined positions, e.g. either one vertical and the other horizontal or both at 45° to the vertical and horizontal.

Such apparatus is widely used. Although it is very helpful for engineering drawings, it tends to be cumbersome in operation. It is also expensive to manufacture, particularly to the necessary high accuracy.

In terms of attaching the piece of paper or draughting film on to the drawing board, this is conventionally done using masking tape. However, in recent years it has become known to provide the surface of the board with a permanently magnetised material and to hold a sheet of paper or the like down by the use of magnetic strips (usually flat strips of stainless steel) which sandwich the paper or draughting film between themselves and the board.

Another approach to drawing by hand a set of parallel lines, e.g. for cross hatching or the like, is to use a drawing instrument referred to as a "parallel rolling rule". This consists of a ruler having set adjacent its ends a pair of rollers. The axis of each roller is parallel to the ruler edge, and the rollers are so positioned that when the ruler is rested on a drawing surface, it may be moved in a direction perpendicular to the edge by rolling it on the rollers. Such rulers are of particular value in drawing parallel lines on navigational charts, being generally easier to use than a pair of standard parallel rules (two rules connected together by means of two pivotal identical length stays thus forming a parallelogram). Such rulers are, however, only as good as their user in terms of the ability to draw a set of parallel lines, and in particular slippage can occur of one end relative to the other.

British Patent Specifications Nos. 2015756A and 2073106A disclose draughting apparatus using a stripwise magnetised drawing surface in conjunction with a magnetised member such as a set-square; such apparatus is inflexible in use, though parallel lines can be drawn with it.

We have now found that by the use of particular magnetic apparatus, substantial improvements in drawing and draughting boards, and in drawing instruments for use therewith may be made.

According to a first feature of the present invention there is provided drawing apparatus comprising a drawing board having at least one permanently magnetised surface, the magnetisation being in the form of a series of alternating poles extending in parallel straight lines across the board surface, and a draughting device for cooperation therewith, the device including a housing in which a magnetic cylindrical member is mounted so as to rotate freely about its longitudinal axis, the cylindrical member having an arrangement of alternating poles around its cylindrical surface, the spacing of the poles being substantially equal to the spacing of the poles on the board surface and each pole extends substantially axially along the cylindrical surface, characterised in that the housing comprises a first part and a second part which are relatively rotatable about an axis transverse to the longitidudinal axis of the cylindrical member.

By cylindrical member we mean a member having a surface which can be caused to move around an axis where a point on the surface of the cylindrical member, on such rotation makes a loop in a plane transverse to that axis. The simplest, and for most embodiments preferred, cylindrical member is a cylinder. The term includes, however, arrangements of two (or more) rollers and a flexible belt surrounding them, in which turning the rollers moves a point on the belt (the outer surface of which then constitutes the outer surface of the cylindrical member) through an elongated looped path having two (or more) straight sections and two semi-circular (or more than two arcuate sections. For simplicity, the following description will refer solely to a cylinder.

Because of the mutual attraction of opposite magnetic poles, such a draughting instrument can be aligned with the surface of the drawing board and has a very distinctly preferred orientation with the poles on the cylindrical member aligned with the poles in the surface of the board. Because the cylindrical member can rotate, the position of the instrument may vary infinitely across the board, both in the direction of the magnetic poles in its surface and transverse thereto. The cylindrical member always rotates to bring its north and south poles towards and matching the south and north poles on the board surface. If the cylindrical member were fixed, then in addition to its assuming a preferred orientation, the drawing instrument would tend to move to one of a plurality of positions equally spaced apart across the board.

By the use of sufficiently sharply defined poles and sufficiently long cylindrical members, the relative orientation of part of the draughting instrument or of the draughting instrument itself and the board can be accurately set, and will remain set the same over the entire surface of the drawing board. This magnetically preferred orientation can be easily and unambiguously detected by the drawing instrument or by its user. If desired, more than one cylindrical member may be used.

It is particularly preferred to mount the cylindrical member in such a way that it is held slightly away from the surface of the drawing board. This enables the cylindrical member to rotate freely e.g. in a simple pair of journals, and to enable the instrument to be moved either along the cylinder axis or transverse thereto, in both cases parallel to the plane of the board, without frictional effects arising which could make movement preferentially easier in some directions than others, or detract from accurate orientation.

Normally, the linear magnetic poles will be arranged for convenience to run either horizontally across the drawing board, which will be of conventional rectangular shape, or vertically up and down it. In such a case it is convenient normally to have the cylinder exterior with poles running axially along it so that the cylindrical member itself orientates horizontally or vertically respectively. However, if desired, the same effect may be achieved by having a fairly low helix angle on helical poles around the magnetised cylinder, and having the lines of magnetisation running at a corresponding angle to the edges of a rectangular drawing board.

The automatic alignment between part of the drawing instrument and the base of the board is secured magnetically and is easily reset. Because the lines of magnetisation in the surface of the board are fixed and do not move, there is nothing to wear out. The top surface of the drawing board may be wholly unimpeded and the drawing instrument may be simply laid on the board when desired for use and removed when not. This considerably improves the ease of working with the drawing instrument.

A wide variety of drawing instruments may be designed which may form part of a combination as set out above. Two are described below, viz. a pair of rules mounted on a carriage and a ruler/protractor. These and analogous instruments, all of which include a rotatably mounted cylindrical member with substantially axially running magnetic poles on its surface, constitute further features of this invention.

Thus in one particular embodiment the present invention provides, for use with a drawing board as set out above, a carriage consisting of a housing, a freely rotatable magnetised roller located within the carriage, the outer surface being a plurality of radially alternating axially extending magnetic poles, means for enabling the carriage to be set on the drawing board surface so as to move freely about the same, preferably with the roller held spaced from the drawing board surface by a small distance, and a drawing device mounting arrangement on the carriage. The drawing device mounting arrangement may include, for example, a pivotal member having means for swivelling it relative to the carriage through a defined angle for locking it in any given position or at a spaced angular positions, and means for securing a drawing device to the pivotal member, e.g. one or more rules. Preferably a pair of rules set at right angles to one another is so secured.

In an alternative, the present invention provides, for use with the drawing board as set out above, a ruler/protractor device comprising a ruler, a housing attached to the ruler, a disc mounted for rotation in the housing about an axis perpendicular to the plane of the ruler, and, attached to the disc, a magnetised roller having axially or substantially axially running magnetic poles about its periphery, the roller being freely mounted. Preferably the disc and the ruler housing have a pointer and scale cooperating means, one being on the disc and the other on the housing, enabling the relative angular positions of disc and housing to be ascertained. Preferably the roller is mounted in such fashion that it is held away from the surface of the drawing board when the ruler is placed thereon.

In a particularly useful embodiment, the roller is mounted on the disc in resiliently sprung fashion biased to a position away from the board and attractable, when the roller and board are magnetically aligned, to a position closer to, but still spaced from, the board surface. Such an arrangement enables the disc to self-align positively and accurately without being actuated by the user, who simply places the housing on the board and rotates it until the disc "locks on", whereafter further rotation of the housing turns the housing but not the disc. By suitable choice of magnetic strength and board-/roller spacing, false positional locking can be avoided; otherwise, there might be two or four other orientations giving weak but perceptible alignment to either side of the proper alignment.

The preferred material of use for the magnetised surface of the drawing board and for the external surface of the freely rotatable cylinder is a sheet of plastics material filled with permanently magnetic material, particularly permanently magnetised barium ferrite. Such materials are available in commerce. Alternatively, the roller may be of solid material, e.g. sintered ferrite.

The pattern of magnetic poles on the drawing board surface may be one of alternating strips of north and south polarity, enabling the roller to align at two positions 180° apart from one another. An alternative configuration is that of lines of evenly spaced north and south poles, with the north poles in one line occurring between the two adjacent south poles in the lines above and below, and vice versa. This arrangement looks the same if rotated through 90°, so the roller may align in any one of four 90° spaced apart orientations. Other patterns of intersecting lines of spaced poles could be used.

The invention is illustrated by way of example with reference to the accompanying drawings, in which.

Figure 8:
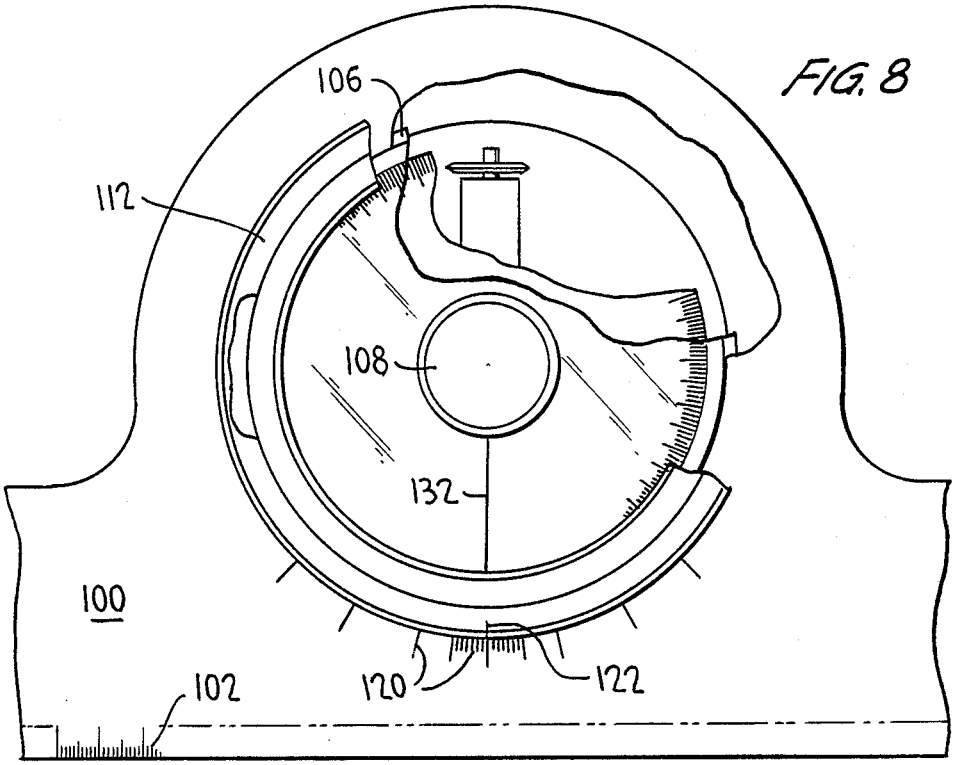
Figure 9:
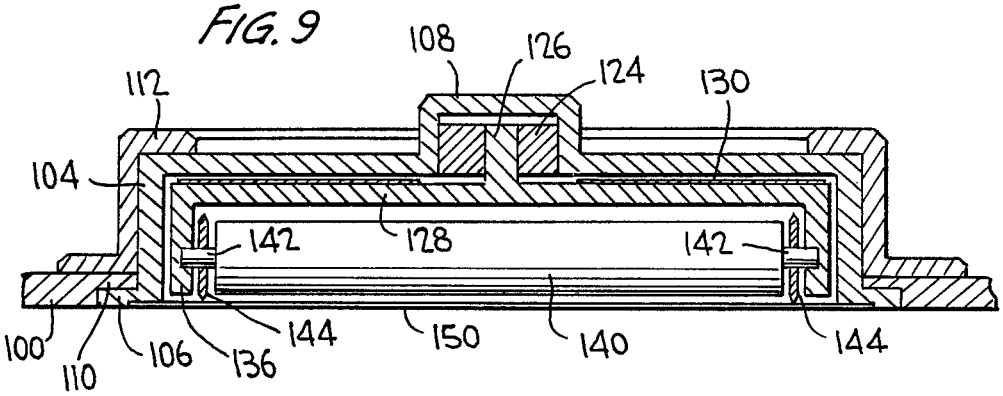
Figure 10:
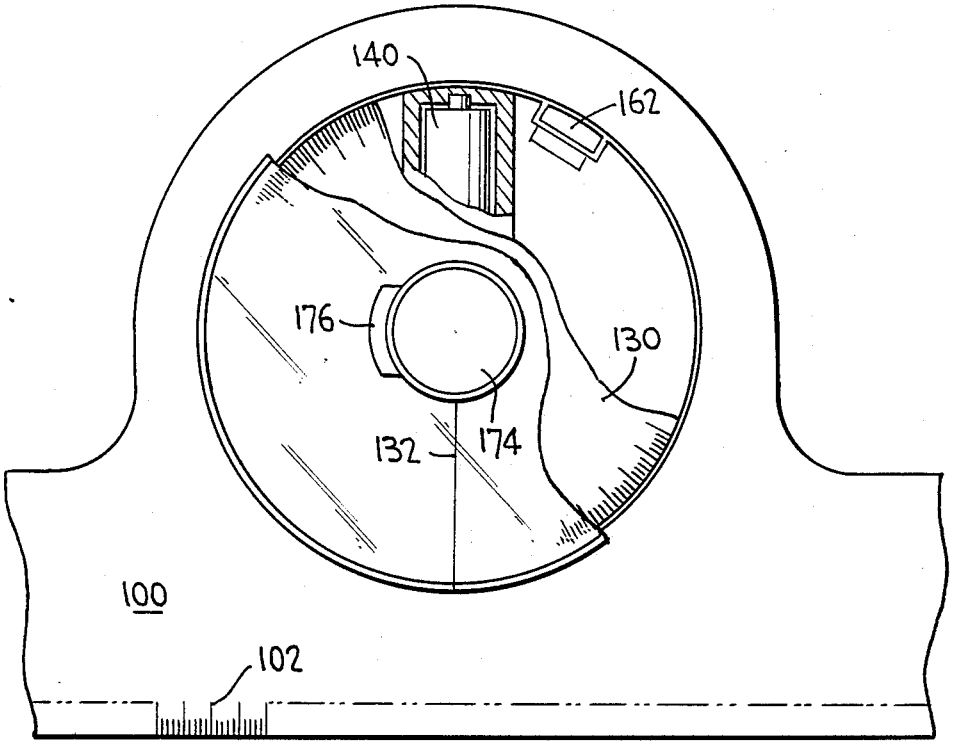
Figure 11:
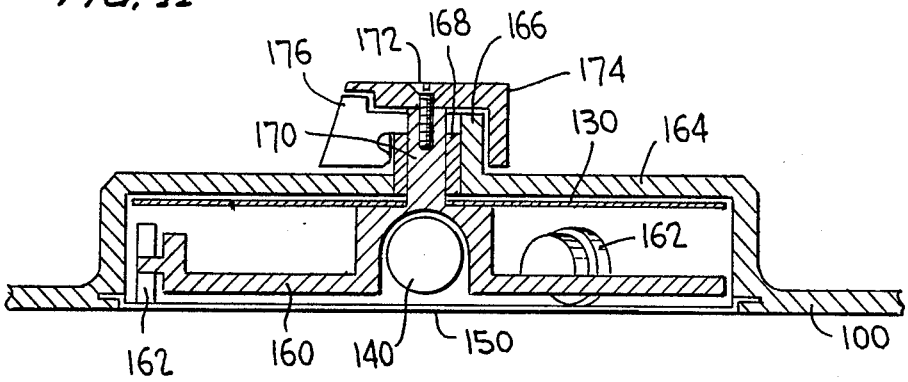

FIGS. 8 and 9 are plan and vertical sectional views respectively of a ruler-protractor unit, in one embodiment, and FIGS. 10 and 11 are views similar to FIGS. 8 and 9 of an alternative ruler-protractor unit.

Figure 1:
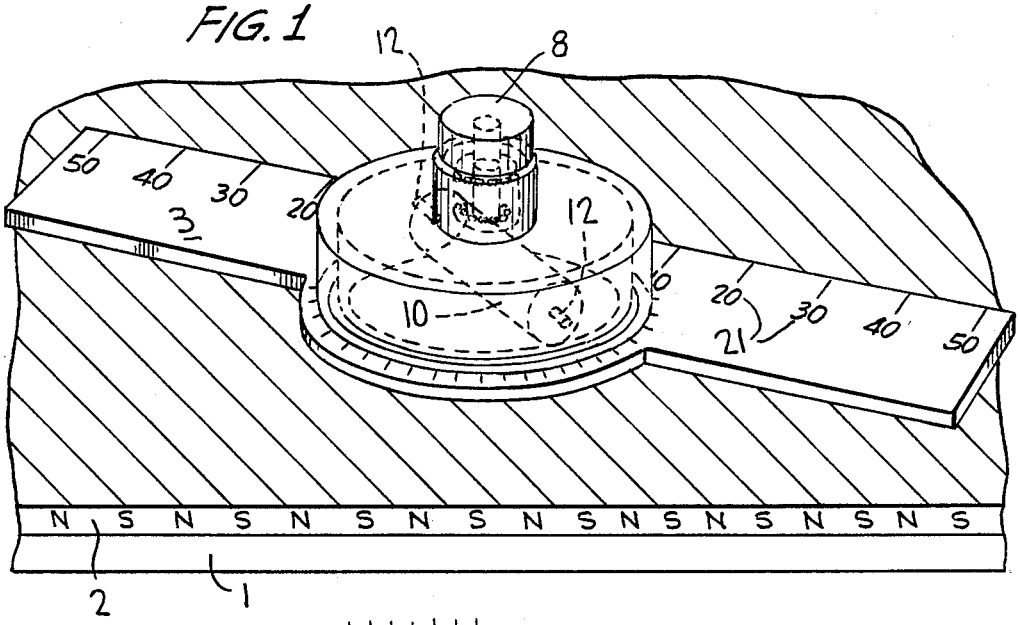
FIG. 1 is a perspective view of ruler/protractor device set on a drawing board in accordance with the present invention.
Figure 2:
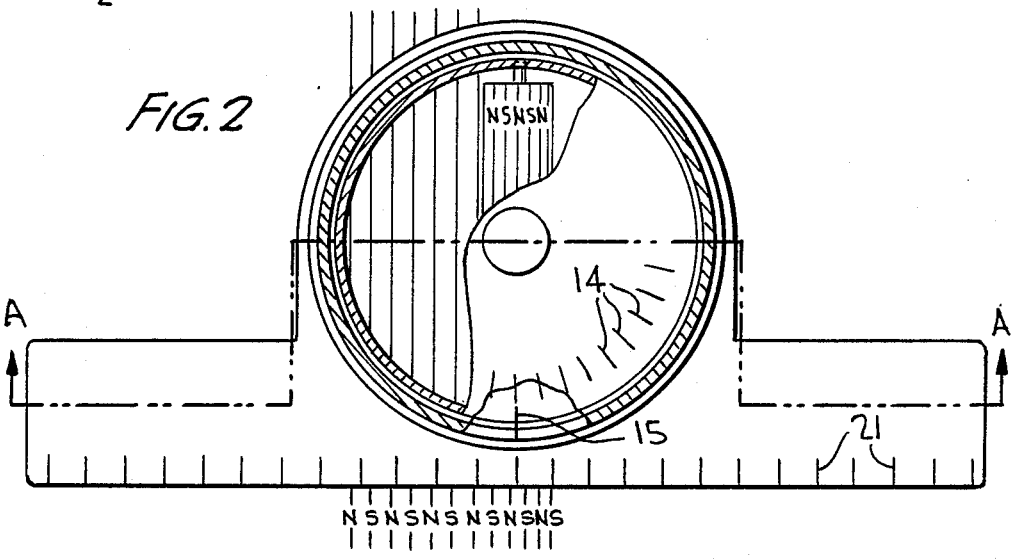
FIG. 2 is a plan view of the ruler/protractor device of FIG. 1.
Figure 3:
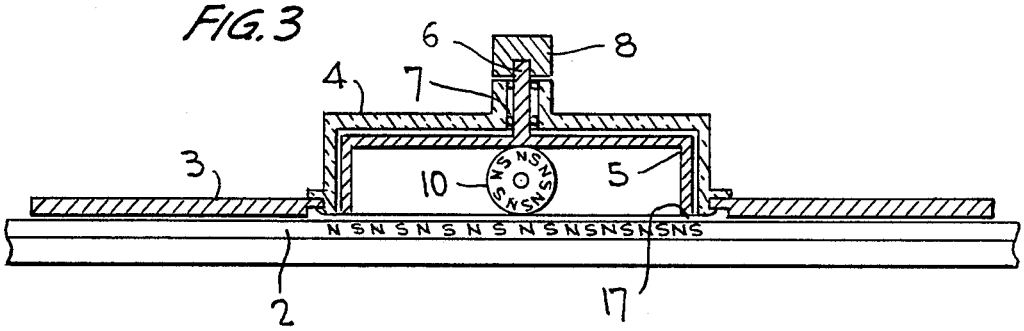
FIG. 3 is a section along the lines A—A of FIG. 2.
Figure 4:
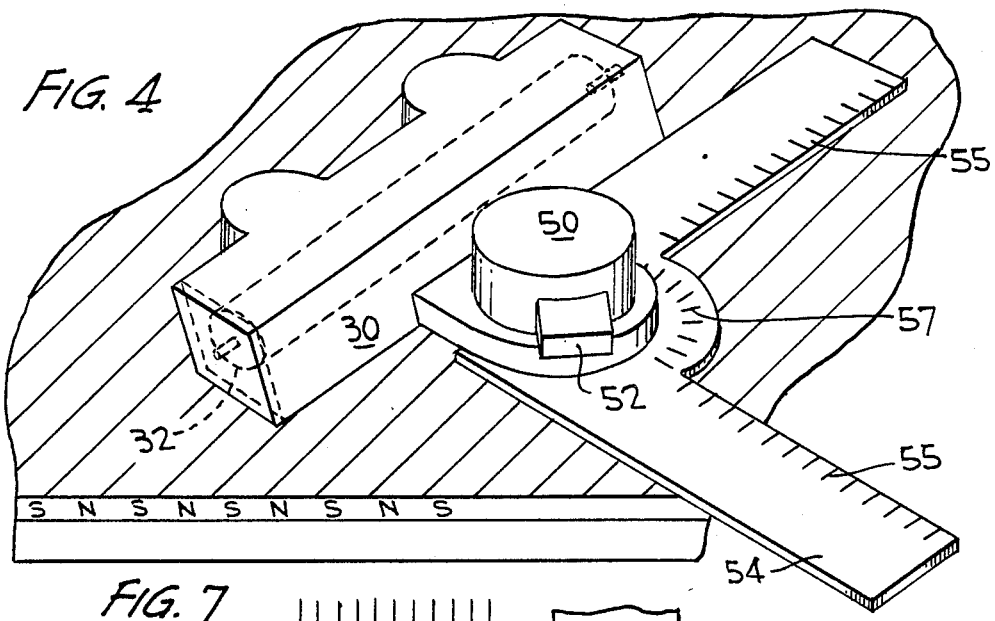
FIG. 4 is a perspective view of an alternative drawing instrument.
Figure 7:
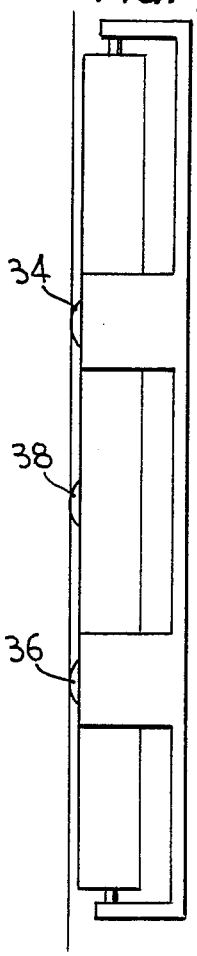
FIG. 7 is a side view of the instrument, seen from the left as shown in FIG. 5.

Referring to FIGS. 1 to 3 these show a ruler/protractor set on the surface of a drawing board. The board consists of a flat multi-ply wooden or other suitable material base 1, to the front surface of which is attached a sheet of plastics material 2, which consists of a vinyl matrix containing distributed therein particles of barium ferrite. The ferrite material has been magnetised in such a way that, as indicated on FIG. 1, the surface is permanently magnetised with lines of north and south poles alternating regularly at a spacing of about 2.5 mm.

Set on the surface of the drawing board shown in FIG. 1 is a ruler/protractor device consisting of a translucent plastics rule 3 having attached thereto a generally cylindrical casing 4 in which is mounted a rotatable housing 5. Housing 5 is generally in the shape of a short cylinder having one closed end and integral with the closed end is a shaft 6 co-axial with the housing 5. Shaft 6 passes through a bearing housing in casing 4 in which it is supported by bearing means 7 not shown in detail. Set on the upper end of shaft 6 is a knob 8.

Housing 5 can spin about its axis freely in bearing 7. Spanning its interior is a cylinder 10, the outer surface of which is covered with a sheet of magnetic material of the same type as sheet 2 on the surface of the board. Thus around the outside of cylinder 10 there are magnetic alternating north and south axially extending poles at a spacing of about 2.5 mm. Cylinder 10 is supported on two axial stub shafts 12 which engage in apertures in the cylindrical portion of member 5 so it can rotate freely.

The upper surface of member 5 bears a series of graduations 14 e.g. conventionally marked off in 360°. The outer casing 4 which is made of transparent or translucent material bears a cursor mark 15 which can be used to read off angles relative to graduations 14. Casing 4 is also rotatable relative to rule 3 to enable the cursor mark to be set relative to the edge of the rule 3 as desired.

As can be seen from FIG. 3, there is a small gap 17 between the surface of the drawing board 2 and the rotatable housing 5. Thus, when the ruler/protractor is laid on the surface of the drawing board, the housing 5 may rotate (if it happens to have landed in a null position assisted by a quick twist on knob 8) to a position in which the linear magnetic poles on cylinder 10 are aligned with the linear magnetic poles on the surface of the drawing board.

The rule 3 may now be slid to any position on top of the drawing board. Irrespective of the direction of the ruler and irrespective of what movements are made, the cylinder 10, and thus the scale 14, remains in the same alignment relative to the drawing board itself. Thus, if the person using the device wishes to draw parallel lines, all he needs to do is, each time a line has to be drawn, to align cursor 15 with the same one of graduations 14. Parallel lines may then may the be drawn along the edge of ruler 3. Ruler 3 contains a linear distance scale along one edge with graduations 21 for convenience.

If desired, the ruler/protractor may contain additional means, e.g. a set of markings on member 5 and casing 4 which, by the use of a moiré fringe effect, enable accurate resetting to a null position. Equivalent optical or opto-electronic means may be used, or some mechanical means e.g. a dial-gauge type of indicator. Instead of or in addition to a marked scale, the device may include an encoder disc and means for displaying angles digitally, e.g. on an LCD. In the latter case, a zero display provides an easily usable system for resetting to a null position.

The overall "drawing instrument" shown in FIGS. 1 to 3 is a ruler, However, the non-central portions of the instrument may be configured differently, e.g. as two rules at right angles, or as a set square. The central part can, if desired, be constructed as a separate unit engageable in a variety of drawing instruments, such as rulers, squares, NC scribers, each of which has a mating aperture to receive the central unit.

Referring now to FIGS. 4 to 7 inclusive, these show a different drawing instrument usable with the board and which consists fundamentally of a housing 30 having a cylinder 32 with magnetic poles round its periphery mounted inside the housing. The housing itself rests on the drawing board surface via three freely rotatable balls set in sockets. Two of the balls sit in PTFE cages formed in housing 30 and are denoted 34 and 36, while the third, 38, sits in a PTFE cage set in a rotatable member 40. Member 40 consists of a large actuation knob 50, having latch means 52 for a purpose explained below, a cage surrounding ball 38 and a generally L-shaped member 54. Member 54 is effectively an integral member made of transparent plastics material and appropriately graduated, having two edges 55 set accurately at right angles one to another, each edge bearing a set of graduations, e.g. centimeter and millimeter graduations, and with an arcuate set of graduations 57 marked on the surface of member 54 adjacent the actuation knob 50.

Figure 5:
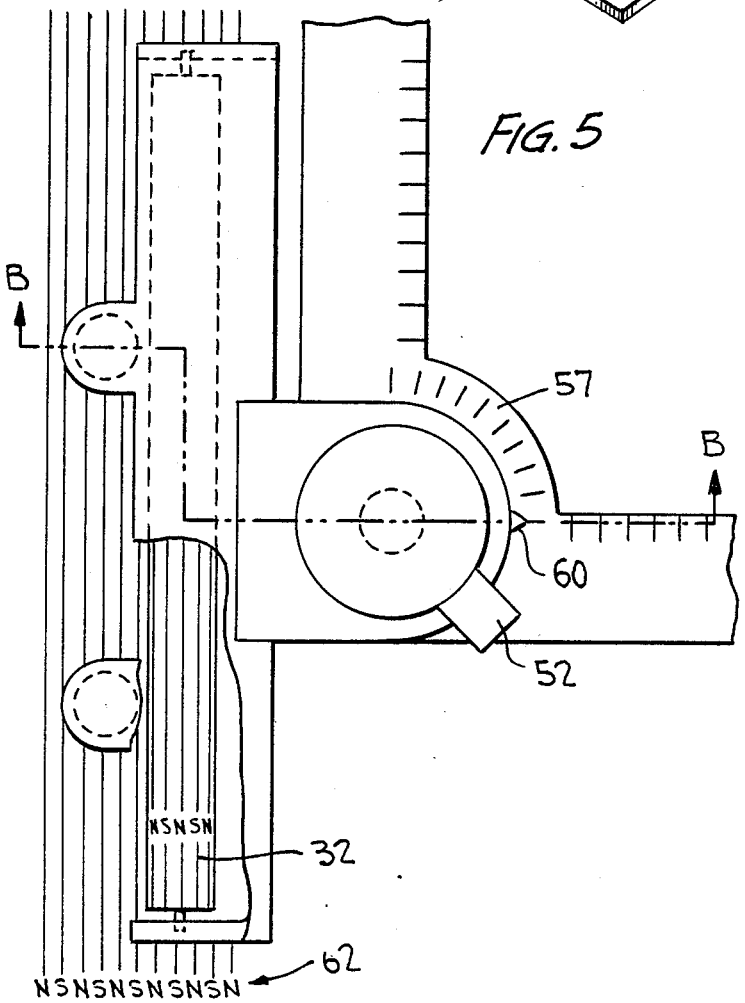
FIG. 5 is a plan view of that drawing instrument of FIG. 4.
Figure 6:
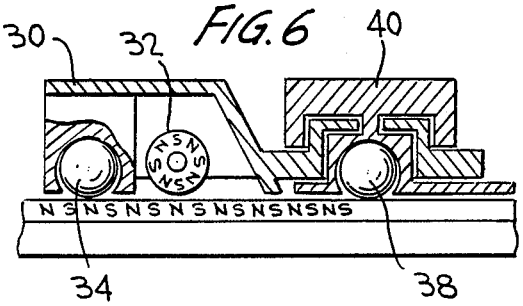
FIG. 6 is a section along the lines B—B in FIG. 5.

Actuation knob 50 and member 54 are mounted so that they are fixed relative one to another but can turn relative to housing 30 through 90° about an axis perpendicular to the plane of the paper on which FIG. 5 is represented. Housing 30 bears a pointer 60 cooperating with the graduations 57 to enable the relative orientation of the housing 30 and one of the straight edges 55 to be read off. Since housing 30 is oriented by means of magnetised cylinder 32 and the alternating poles on the surface of the board as indicated at 62, this means that pointer 60 and graduations 57 may be used to read off or set the angle between one of straight edges 55 and the drawing board itself. Actuator 52 is used to latch member 54 into one of a few standard positions relative to the orientation of cylinder 32 or to let it be moved freely between them. It engages with suitable formations on housing 30 in the interior of actuation knob 50.

It can be seen that the drawing instrument of FIGS. 4 to 7 inclusive can be used in very similar fashion to the carriage and mounting arrangements in conventionally available draughting machines. However, the instrument is far more flexible insofar as it can be turned through 180° by simply bodily picking it up and turning it round (of particular value for the left-handed draughtsman) and, in addition, when not required for use, it can simply be removed from the board, leaving the whole of the surface of the drawing board unimpeded.

Referring now to FIGS. 8 and 9 these show the centre section of a ruler-protractor device consisting essentially of a transparent acrylic rule 100 having a graduated edge 102 and having a broadened centre section including a circular aperture in which is set a transparent circular housing 104. Housing 104 has a generally cylindrical shape having an external lower flange 106 and an upper transverse wall with a mounting boss 108 moulded therein. Flange 106 mates with a corresponding flange 110 and casing 104 is held captive in the ruler base 100 by means of a mounting bezel 112. Bezel 112 may be used to rotate the housing relative to the ruler, and the circular aperture in the ruler base 100 bears graduations 120 and the bezel a reference mark 122 enabling setting of the relative rotary position of the housing and the ruler to be achieved.

Mounted inside mounting boss 108 is a bearing bush 124 in which is rotatably set a shaft 126 which projects upwardly from a rotatable disc 128. Attached to the upper surface of disc 128 is a 360° divided circular scale 130. The position of scale 130 may be read relative to a reference line 132 engraved on the upper surface of housing 104.

Depending from disc 128 is a cylindrical skirt 136 having set therein a roller 140 having an external periphery which is magnetised in a series of axial strips of alternating north and south poles. At the ends of roller 140 are two stub shafts 142 each of which carries a fixed support wheel 144 of diameter slightly greater than that of the roller 140.

A thin cover plate 150 spans the base of housing 104 to provide a closed unit surrounding the rotatable disc 128 and its associated components.

Roller 140 is mounted in the skirt 136 in such a way that it can be bodily moved up and down by a small amount, being resiliently sprung upwards as seen in FIG. 9. This can be achieved e.g. by supporting shafts 142 at their ends in vertically extending slots in the skirt 136, with a spring being located near the base of the slot on which spring the end of shaft 142 rests.

It will thus be seen that the assembly of disc 128 and associated components is free to rotate within housing 104, and it will rotate freely unless the roller 140 is subjected to magnetic influence. If the unit shown in FIGS. 8 and 9 is placed on a drawing board of the type described above and the whole unit then rotated about the axis of shaft 126, the housing 136 will rotate with the remainder of the item until the roller 140 aligns with the magnetic stripes on the board. At this point the magnetic attraction will pull the roller slightly downward, bringing the wheels 144 into contact with sheet 150, and thereafter housing 104 may be rotated but without disc 128 rotating. Shaft 126 can slide axially in bearing bush 124 to enable this to take place. By adjusting the distance from the board surface to the roller when the latter is in its upper position, it can be ensured that only the single unique proper alignment gives sufficient magnetic force to pull the roller down into magnetic engagement with the magnetised surface of the board.

Once the ruler-protractor of FIGS. 8 and 9 is placed on a drawing board and rotated to align roller 140 with the magnetic strips as just described, the angle of its graduated edge 102 relative to the stripes on the board may then be read off using the graduated scale 130 and the reference line 132.

FIGS. 10 and 11 show a ruler-protractor device of similar construction to that shown in FIGS. 8 and 9, but in which the central rotary member is not mounted always for free rotation, but rather can be locked in position as desired. Similar components are identified in FIGS. 10 and 11 with identical reference numbers to those used in FIGS. 8 and 9. In place of the freely rotatable disc 128 and its associated components however there is a rotatable disc 160 having set at three equiangularly spaced positions peripheral rollers 162. These roll on plate 150 which is mounted directly spanning the circular aperture in the underside of ruler member 100. The ruler has an integrally moulded housing 164 having a central bush 166 in which is set a bearing bush 168 in which an upstanding shaft 170 forming part of moulding 160 can rotate. Attached to shaft 170 by a fixing screw 172 is a turning knob 174 which has a locking catch 176 set in it. Catch 176 may engage boss 166 or the bearing boss 168 to lock knob 174 rotationally relative to the ruler.

The devices shown in FIGS. 8 to 11 are particularly useful for navigational purposes as well as in various draughting applications.

In addition to the simple draughting instruments described above, the principle of the present invention may be applied to substantially more sophisticated drawing and draughting instruments. In particular, the principle may be applied in the design of electronically controlled draughting apparatus. Magnetic sensors may be mounted adjacent the cylindrical member and these may be connected with appropriate electronic circuitry to monitor the movement of the cylindrical member about its axis. If two cylindrical members set at right angles are used in conjunction with a drawing board having a surface with intersecting lines of spaced north and south poles, the instrument may form the input unit for a digitiser. As the instrument is moved across the drawing board surface e.g. with a reference mark on the instrument tracking a line drawn on a drawing on the board's surface, signals from the sensors may be converted to positional coordinates for the line. The system may also be used the other way round e.g. as a plotter. If the instrument is provided with suitable drive means to drive it relative to the boards surface e.g. in two directions at right angles, then that combined with the feedback signals from the sensors adjacent the cylindrical members, which rotate as the instrument is driven across or up and down the board, may be used to provide a finely controllable plotting unit, e.g. with a pen attached in a suitable position on the device.

We claim:

1. Drawing apparatus comprising a drawing board having at least one permanently magnetised surface, the magnetisation being in the form of a series of alternating poles extending in parallel straight lines across the board surface, and a draughting device for cooperation therewith, the device including a housing having first and second parts, the first part being freely rotatable relative to the second part about an axis perpendicular to the board surface when the second part is resting on the board surface, and the device further including a magnetic cylindrical member mounted in the first part of the housing so as to rotate freely about the longitudinal axis of the magnetic cylindrical member, the cylindrical member having an arrangement of alternating poles around its cylindrical surface, the spacing of the poles being substantially equal to the spacing of the poles on the board surface, and each pole extending substantially axially along the cylindrical surface of the magnetic cylindrical member.

2. Drawing apparatus according to claim 1, characterised in that the first part forms a hollow cylinder which has the cylindrical member spanning its interior.

3. Drawing apparatus according to claim 2, characterised in that the second part forms a transparent, cylindrical casing which surrounds the first part.

4. Drawing apparatus according to claim 3, characterised in that the first and second parts have a cooperating pointer/scale arrangement for enabling the relative angular positions of the two parts to be determined.

5. Drawing apparatus according to claim 4, characterised in that the pointer is formed on the first part.

6. Drawing apparatus according to claim 4, characterised in that the pointer is formed on the second part.

7. Drawing apparatus according to claim 1 and including a rule fixed to the second part of the housing.

8. Drawing apparatus according to claim 1 and including means for holding the magnetic cylindrical member spaced slightly away from the permanently magnetised surface.

9. Drawing apparatus according to claim 8, characterised in that the magnetic cylindrical member is movable in its housing part perpendicular to the permanently magnetised surface and is spring biased away from the permanently magnetised surface.

10. Drawing apparatus according to claim 1 and including a rule rotatably mounted on one of said first and second housing parts and a locking catch for locking the rule in a desired angular position with respect to the respective housing part.

* * * * *